United States Patent [19]

Bixel et al.

[11] Patent Number: 4,783,199

[45] Date of Patent: Nov. 8, 1988

[54] METHOD FOR PRODUCING A DEACTIVATED DRIED COAL

[75] Inventors: John C. Bixel, Washington Crossing, Pa.; Michael J. Dabkowski, Mickleton, N.J.

[73] Assignee: Mobil Oil Corporation, New York, N.Y.

[21] Appl. No.: 45,261

[22] Filed: Apr. 20, 1987

Related U.S. Application Data

[63] Continuation of Ser. No. 798,513, Nov. 15, 1985, abandoned.

[51] Int. Cl.[4] ..... C10L 5/00; C10L 5/24

[52] U.S. Cl. ..... 44/501

[58] Field of Search ..... 44/1 R, 1 G, 6, 501

[56] References Cited

U.S. PATENT DOCUMENTS

| | | | |
|---|---|---|---|
| 4,201,657 | 5/1980 | Anderson et al. | 44/6 |
| 4,265,637 | 5/1981 | Anderson | 44/6 |
| 4,524,227 | 6/1985 | Fowles et al. | 585/408 |

*Primary Examiner*—Carl F. Dees

*Attorney, Agent, or Firm*—Alexander J. McKillop; Michael G. Gilman; Van D. Harrison, Jr.

[57] ABSTRACT

Particulate coal is rendered less subject to spontaneous ignition by spraying or otherwise contacting it with a light cycle oil, heavy cycle oil, clarified slurry oil, a solution of durene in gasoline and mixtures of two or more of the preceding.

10 Claims, No Drawings

METHOD FOR PRODUCING A DEACTIVATED DRIED COAL

This is a continuation of application Ser. No. 798,513, filed on Nov. 15, 1985, now abandoned.

NATURE OF THE INVENTION

This invention relates to improved methods for producing a dried particulate coal fuel having a reduced tendency to ignite spontaneously. More specifically, it relates to a composition to be applied to dried coal to render it less susceptible to spontaneous ignition.

BACKGROUND OF THE INVENTION

Although low sulfur, sub-bituminous coal is readily available it may have such a high moisture content and low heating value that it is of little use as a fuel. Thermal drying to reduce the moisture content of the coal can upgrade its heating value to a point where the dried coal can compete favorably with many bituminous coals. With a low sulfur content such coal can meet clean air requirements for many power plants and make a major contribution to reducing sulfur dioxide emissions and acid rain. The drying required with such low rank coals is a deep drying process to remove both surface water and large quantities of interstitial water present. The handling, storage and transportation of such deep dried coal can present technical problems resulting from the friability and dustiness of the coal, as well as its tendencies to readsorb moisture and react with oxygen from the air. Spontaneous combustion can result from heats of moisture readsorption and oxidation. Removing moisture inherent in the coal structure can also reduce the strength of the coal particle by cracking or fissuring, causing friability and dusting. The number of active surface sites exposed within the coal particles can also thus be increased, thereby increasing undesired moisture adsorption and oxidation.

It has been previously proposed to spray dried coal with hydrocarbons, to countereffect the effects of too rapid drying and reaction with atmospheric moisture and oxygen. For example, U.S. Pat. No. 4,201,657 discloses a composition for treating coal and lignite wherein the material is treated with a composition made up of a blend of aromatic hydrocarbon oil and asphalt. Similarly, U.S. Pat. No. 4,265,637 discloses treating lignitic type coal after it has been dried with a hydrocarbon liquid having a minimum flash point of 65° C. such as No. 6 fuel oil, residual oil, heavy distillates and other low value refinery streams. U.S. Pat. No. 4,396,394 discloses the use of a deactivating fluid to treat a dried, partially oxidized coal. U.S. Pat. No. 4,402,707 discloses the treatment of dried coal with a virgin vacuum reduced crude oil.

SUMMARY OF THE INVENTION

Briefly stated, this invention comprises treating dried crushed mined coal particles with a hydrocarbon composition which is a cycle oil, or mixture of cycle oils, both heavy cycle and light, and clarified slurry oil derived in the refining of petroleum hydrocarbons. Preferably the mixtures contain mainly heavy cycle oil in a proportion of between 10 to 90 volumes of heavy cycle oil, 0 to 50 volumes of light cycle oil and 0 to 50 volumes of clarified slurry oil. A mixture containing a ratio of 2 volumes of heavy cycle oil to 1 volume of light cycle oil is particularly preferred.

DETAILED DESCRIPTION OF THE INVENTION

This invention is an improved method of reducing the tendency of dried coal to ignite spontaneously. Coals may be dried to remove surface water or deep dried to remove interstitial water and thereby increase the heating value of the coal. In this description dried coal is coal that has been dried to remove some of the interstitial water and the moisture content of a dried coal as measured in accordance with the procedures set forth in ASTM D3173-73 entitled "Standard Test Method For Moisture in the Analysis Sample of Coal and Coke" published in the 1978 Annual Book of ASTM Standards, Part 26. Techniques for drying coal are discussed in U.S. Pat. Nos. 4,396,394 and 4,402,707 both of which are incorporated herein by reference. The method of this invention is applicable to all forms of dried coal, especially deep dried coal, but is especially useful for dried low grade coals such as sub-bituminous, lignite and brown coals.

In the method of this invention, dried coal particles are sprayed with a deactivating oil composition which comprises cycle oil from the petroleum refining process. Cycle oil is defined as the predominantly aromatic fraction obtained from the catalytic cracking of petroleum fraction and having a boiling range of 400° F. of 900° F.

As noted previously, particularly preferred is a mixture of a light cycle oil, heavy cycle oil, and clarified slurry oil. Heavy cycle oil is that portion of cycle oil boiling between 700° F. and 900° F. Light cycle oil is that portion of cycle oil boiling between 400° F. and 700° F. Clarified slurry oil is the highly aromatic fraction from catalytic cracking which boils above 900° F.

Preferably the oil has a characterization factor of between 10 and 11. The characterization factor is a special physical property of hydrocarbons defined by the relationship:

$$K = \frac{T_b^{\frac{1}{3}}}{G}$$

where

K—Characterization factor $T_b$=Cubic average boiling point °R.

G=Specific gravity 60° F./60° F.

*R=°F.+460.

The cubic average boiling point is determined in accordance with the calculations mentioned in an article entitled "Boiling Points and Critical Properties of Hydrocarbon Mixtures," by R. L. Smith and K. M. Watson, appearing in Industrial and Engineering Chemistry, Volume 29, pages 1408–1414, December, 1937, and using the ten, thirty, fifty, seventy, and ninety percent points °F. as measured by the procedures of ASTM D1160-77, previously described or ASTM D86 entitled ∓Standard Method for Distillation of Petroleum Products", published in the 1978 Annual Book of ASTM Standards, Part 23. ASTM D86 is for products which decompose when distilled at atmospheric pressure.

Accordingly, in the method of this invention after the dried coal particles have been removed from the coal drying system they are contacted with the catalytic cycle oil of this invention such as by spraying. The catalytic cycle oil contains alkyl naphthalenes and other aromatics and is less viscous than some of the previously proposed coal treating agents. The liquid composition of this invention may be used in any desired quantity, but between 0.2 and 5 gallons of oil per ton of dried coal will ordinarily be adequate. The preferred range is between 0.5 and 2 gallons of oil per ton of dried coal.

The treating agent of this invention was evaluated in a number of pilot plant tests. In these tests several different sets of drier operation conditions were utilized, each chosen to dry the coal below 10 wt.% moisture and some of the cycle oil compositions disclosed herein were applied to the dried coal products at various levels. Tests to determine dustiness, tendency for spontaneous ignition and tendency for moisture reabsorption were conducted.

Evaluation of the results indicated that one treating agent of a particular composition ($\frac{2}{3}$ heavy cycle oil, $\frac{1}{3}$ light cycle oil), when applied to the dried coal, was particularly effective in inhibiting spontaneous ignition under the test conditions used. Visual observations of the treated samples indicated a reduction of dust after application of the oils.

In addition to the light cycle oil combinations of this invention it is also possible to use a mixture of gasoline and durene resulting from the conversion of synthesis gas to Fischer-Tropsch products and the subsequent conversion of these products from the Fischer-Tropsch process into gasoline by contacting them with a zeolite of the ZSM-5 type. Similarly methanol is converted also to a mixture of gasoline and durene by contacting it with a ZSM-5 catalyst. These processes are set forth in U.S. Pat. Nos. 4,524,231; 4,524,228; 4,524,227, all of which are incorporated herein by reference. The gasoline-durene mixture available in the processes described therein will range from 10 to 30 percent concentration of durene.

We claim:

1. A method for producing a dried particulate coal fuel having a reduced tendency to ignite spontaneously comprising spraying and intimately mixing said dried coal with a deactivating composition selected from the group consisting of light cycle oil, heavy cycle oil, clarified slurry oil, and mixtures of two or more of the preceding.

2. The method of claim 1 wherein said cycle oil has a K value of about 10 to about 11.

3. The method of claim 1 wherein said dried particulate coal is selected from the group consisting of subbituminous, lignite, brown coals and combinations thereof.

4. The method of claim 1 wherein said dried coal is sprayed with between about 0.2 and about 5 gallons of cycle oil per ton of coal.

5. The method of claim 1 wherein said dried coal is sprayed with between about 0.5 and about 2 gallons of deactivating agent per ton of coal.

6. A method for producing a dried particulate coal fuel having a reduced tendency to ignite spontaneously comprising spraying and intimately mixing said dried coal with a deactivating composition comprising a mixture of about 2 volumes of heavy cycle oil to about one volume of light cycle oil.

7. The method of claim 10 wherein said deactivating composition is a solution of gasoline and durene containing between about 10 and about 30 percent by weight of durene.

8. The method of claim 1 wherein said deactivating composition of a clarified slurry oil.

9. A method for producing a dried particulate coal fuel having a reduced tendency to ignite spontaneously, comprising spraying and intimately mixing said dried coal with a deactivating composition having a K value of between about 10 and about 11, selected from the group consisting of light cycle oil, heavy cycle oil, clarified slurry oil, solutions of durene in gasoline and mixtures of two or more of the preceding, the ratio of deactivating composition to coal being between about 0.2 and about 5 gallons per ton of coal.

10. A method of producing a dried particulate coal fuel having a reduced tendency to ignite spontaneously comprising spraying and intimately mixing said dried coal with a deactivating composition comprising a solution of durene in a hydrocarbon solvent.

* * * * *